US006966963B2

(12) United States Patent
O'Connor

(10) Patent No.: US 6,966,963 B2
(45) Date of Patent: Nov. 22, 2005

(54) METHOD OF APPLYING A COVERING FOR BOARDS

(75) Inventor: Lawrence J. O'Connor, Venice, FL (US)

(73) Assignee: O'Connor Investment Corporation, Winnipeg (CA)

( * ) Notice: Subject to any disclaimer, the term of this patent is extended or adjusted under 35 U.S.C. 154(b) by 46 days.

(21) Appl. No.: 10/715,566

(22) Filed: Nov. 19, 2003

(65) Prior Publication Data

US 2005/0022927 A1 Feb. 3, 2005

Related U.S. Application Data

(60) Provisional application No. 60/491,252, filed on Jul. 31, 2003.

(51) Int. Cl.[7] ..... B32B 31/10; B32B 33/00
(52) U.S. Cl. ..... 156/249; 156/289
(58) Field of Search ..... 156/247, 249, 156/289, 391, 71

(56) References Cited

U.S. PATENT DOCUMENTS

| | | | | |
|---|---|---|---|---|
| 2,042,692 A | | 6/1936 | Wurzburg | |
| 3,010,589 A | | 11/1961 | Stephens et al. | |
| 3,014,829 A | | 12/1961 | Curtin | |
| 3,135,647 A | | 6/1964 | Wheeley | |
| 3,893,252 A | * | 7/1975 | Chase | 40/773 |
| 3,900,656 A | | 8/1975 | Schmidt | |
| 3,937,640 A | | 2/1976 | Tajima et al. | |
| 4,349,593 A | | 9/1982 | Blechstein | |
| 4,421,809 A | | 12/1983 | Bish et al. | |
| 4,554,194 A | | 11/1985 | Haas et al. | |
| 4,680,209 A | | 7/1987 | Zybko et al. | |
| 4,695,493 A | * | 9/1987 | Friedlander et al. | 428/41.1 |
| 4,849,267 A | * | 7/1989 | Ward et al. | 428/41.3 |
| 4,907,387 A | | 3/1990 | Turnbull | |
| 4,988,551 A | | 1/1991 | Zegler | |
| 5,104,712 A | | 4/1992 | Walters | |
| 5,204,155 A | | 4/1993 | Bell et al. | |
| 5,475,952 A | | 12/1995 | O'Connor | |
| 5,612,113 A | | 3/1997 | Irwin, Sr. | |
| 5,613,339 A | | 3/1997 | Pollock | |
| 5,763,040 A | | 6/1998 | Murphy et al. | |

(Continued)

FOREIGN PATENT DOCUMENTS

DE DT 26 04 258 6/1977

(Continued)

OTHER PUBLICATIONS

U.S. Appl. No. 11/023,412, filed Dec. 29, 2004, O'Connor.

(Continued)

*Primary Examiner*—Chris Fiorilla
*Assistant Examiner*—Sing P. Chan
(74) *Attorney, Agent, or Firm*—Caroline D. Dennison; Roberts Mlotkowski & Hobbes

(57) ABSTRACT

A covering system is designed as an elongated strip of covering material having a fibrous layer and an integral moldable layer for mounting on the upper surface of boards, such as deck planks. In a preferred embodiment, strips are preferably secured to the length of the boards solely by a layer of a hot melt pressure sensitive adhesive carried by the strip. The moldable material is applied in a volume of about at least 185 grams per square meter. A removable release sheet covers the adhesive surface of the moldable material. The release sheet can include a positioning mechanism and indicia such as the direction of the pile and measuring guides. The moldable material provides sufficient adhesion across the width of the strip for both initial application and sufficient thickness for subsequently molding to the board surface for long term adhesion.

15 Claims, 2 Drawing Sheets

U.S. PATENT DOCUMENTS

| | | | | |
|---|---|---|---|---|
| 5,766,722 | A | 6/1998 | Morimoto | |
| 5,794,390 | A | 8/1998 | Oliveri et al. | |
| 5,904,011 | A | 5/1999 | Biro | |
| 5,913,784 | A | 6/1999 | Hite | |
| 5,993,534 | A | 11/1999 | Winterowd et al. | |
| D421,502 | S | 3/2000 | Felch et al. | |
| 6,235,365 | B1 | 5/2001 | Schaughency et al. | |
| 6,357,189 | B2 | 3/2002 | Schlisner | |
| 6,374,555 | B1 | 4/2002 | Gusler | |
| 6,426,129 | B1 * | 7/2002 | Kalwara et al. | 428/41.8 |
| 6,427,395 | B1 | 8/2002 | Elsasser et al. | |
| 6,453,630 | B1 | 9/2002 | Buhrts et al. | |
| 6,479,125 | B1 | 11/2002 | Irwin, Sr. | |
| 6,517,922 | B2 * | 2/2003 | Ang et al. | 428/41.8 |
| 6,689,447 | B2 | 2/2004 | Prevost | |
| 2002/0100231 | A1 | 8/2002 | Miller et al. | |
| 2002/0152712 | A1 | 10/2002 | Smith | |
| 2003/0079421 | A1 | 5/2003 | Yang | |

FOREIGN PATENT DOCUMENTS

| | | |
|---|---|---|
| GB | 1007281 | 10/1965 |
| GB | 2163973 | 3/1986 |
| WO | WO 90/10112 | 9/1990 |
| WO | WO 91/00804 | 1/1991 |
| WO | WO 98/56977 | 12/1998 |

OTHER PUBLICATIONS

U.S. Appl. No. 11/023,413, filed Dec. 29, 2004, O'Connor.
U.S. Appl. No. 11/034,255,filed Jan. 13, 2005, O'Connor.
U.S. Appl. No. 10/880,607, filed Jul. 1, 2004, O'Connor.
U.S. Appl. No. 10/715,562, filed Nov. 19, 2003, O'Connor.
U.S. Appl. No. 10/821,186, filed Apr. 9, 2004, O'Connor.
U.S. Appl. No. 10/821,202, filed Apr. 9, 2004, O'Connor.

* cited by examiner

METHOD OF APPLYING A COVERING FOR BOARDS

CROSS REFERENCE TO RELATED APPLICATIONS

This application claims priority to U.S. Provisional application No. 60/491,252 filed Jul. 31, 2003. The contents of that application are incorporated herein by reference.

STATEMENT REGARDING FEDERALLY SPONSORED RESEARCH OR DEVELOPMENT

[Not Applicable]

REFERENCE TO A SEQUENCE LISTING

[Not Applicable]

BACKGROUND OF THE INVENTION

1. Field of the Invention

This invention relates to coverings for exterior surfaces, especially horizontal surfaces such as floors, decks, and docks. In particular, this invention relates to self securing carpeting usable on building elements and the method of installation.

2. Discussion of Related Art

Decks or platforms formed of boards are well known in the building industry. Decks are commonly used as extensions from buildings, either elevated or at ground surface, like a patio. Docks or piers also commonly have a top surface formed as a deck. As most decks are used outdoors, decks are commonly built as a platform of spaced boards that provide some degree of weather resistance. The spacing between boards promotes drainage of the platform and allows debris to fall between the boards. Decks are very popular in all regions of the world, especially in residential areas.

One of the main attractions of a deck is that is can be formed by relatively simple construction of boards or planks. This construction provides an effective supporting surface at a reasonable cost. Most decks are built of wooden boards, as wood is a relatively inexpensive and easily handled building material. However, exposed wood is liable to deterioration due to the wetting and drying process and year round exposure to the elements and temperature extremes. Thus, the surface can become unsatisfactory in that it can leave dangerous splinters and become slippery when wet.

When the surface of deck boards deteriorates, one solution is to replace them, which is expensive and time consuming. Also, the new boards will be subject to the same deterioration potential as the old boards. Some people choose synthetic deck boards, such as Trex®, to avoid the problems with deteriorating wood. However, synthetic boards are much more expensive, require more sophisticated installation techniques, and can be slippery. Another alternative to dealing with deteriorated deck surfaces is to cover the surface, which is significantly lower in cost than full replacement.

Some users, therefore, cover the deck surface with a carpeting material or the like, which provides a comfortable walking surface, avoids the possibility of splinters, and can inhibit the deterioration of the wood due to weathering. It is of course possible to simply lay a broad band of carpeting over the deck surface covering the boards and the gaps between the boards. This is generally unsatisfactory in that it then inhibits drainage of water from the surface and reduces the ability of the carpet to dry. Such a wide swath of carpet over individual boards also creates an unpleasing aesthetic effect as grooves or lines appear across the carpet. To cover each board individually would require the installer to measure and cut each strip individually and then secure the strip to the board. This obviously requires intensive labor to measure and cut each strip accurately and then to securely attach the cut strips to each board.

The present inventor previously proposed a floor covering material for deck planks in International Application W090/10112 published Sep. 7, 1990. This document discloses a layer of a fibrous floor covering material attached to the upper surface of the deck plank, which covers only the upper surface of the deck plank. The attachment is effected by staples applied in rows adjacent side edges of the covering material. The staples are attached to the under surface of the fibrous material by adhesive bonding strips through which the legs of the staples project for engagement into the upper surface of the wood of the deck plank.

Problems associated with such attachment methods include the necessity of attaching the material to the deck plank at positions adjacent the edges of the plank to ensure effective attachment in view of the instability of the material. Edge attachment tends to form bubbles underneath the material in response to differential expansion, improper application or any kinking of the covering layer. Such bubbles tend to flap or roll when stepped upon, which is simply unacceptable to the user. In addition, the complex construction of such a covering and the large amount of materials are very expensive.

Interior carpet tiles are widely provided as a cheap and efficient replacement for broadloom carpet. Such carpet tiles are often attached directly to the floor by adhesive. There is little difficulty in attaching carpet tiles to the floor since the floor is almost always flat and smooth with no distortion or bowing. In addition, carpet tiles are laid as a continuous surface and, as such, carpet tiles do not generally have exposed edges that can be pulled away from the underlying surface since each edge abuts the edge of the adjacent tile. So, both edges are protected and held down by the continuous surface presented upwardly to the user. An example of adhesive carpet tiles are shown in published PCT application WO98/56977 of Interface Inc. published Dec. 17, 1998, which discloses a carpet tile or piece of carpet having an adhesive on the rear surface covered by a release coat, and U.S. Pat. No. 3,010,859 to Stephens et al.

Although it is known to secure carpet with adhesive in an interior setting, attaching carpet with adhesive to a deck poses additional problems in spreading the adhesive on the boards and then attempting to adhere the carpet to the adhesive quickly before it sets and in a smooth and wrinkle free manner. Even known self-adhesive carpet tiles would be unsuitable to cover decking as such tiles are not appropriately sized to cover deck boards and would require cutting and forming multiple joints along the length of a board, which would be subject to deterioration in outside use. Further, to the best of the inventor's knowledge such use of carpet tiles in an exterior application has not been done. This may be because known carpet tiles have a backing layer, typically foam, to provide insulation and cushioning, which are desired properties in interior carpets. See for example, U.S. Pat. No. 3,014,829 to Curtin. Such foam backing would not be suitable for exterior applications as it would deteriorate under exposure to weather elements, particularly by repeated soakings, and would have a tendency to hold water and not drain well.

Other attempts to form exterior coverings for boards have been made by generating pre-manufactured elements that can be simply applied to the deck boards with the elements having a width substantially equal to the boards to cover the upper surfaces of the boards while leaving the spaces between the boards open for the escape of water. However, these elements are rigid members that form a rigid barrier surface over the decking. Such a rigid member does not conform to boards that are warped or otherwise irregularly shaped.

One arrangement for covering deck planks is shown in U.S. Pat. No. 4,907,387 of Turnbull issued in 1990. Turnbull discloses a patio deck sheath formed as a channel shaped member with a horizontal surface and two vertical depending sides that is placed over the deck member.

In U.S. Pat. No. 5,475,952 issued Dec. 19, 1995, the present inventor disclosed a further proposal for attachment of covering materials to the upper surface of a deck plank. This arrangement discloses the attachment of staples to the center of a stiff covering together with the concept of providing a tendency of the covering to bow across its width thus tending to hold the edges of the covering downwardly onto the edges of the plank. This avoids bubbling and allows effective attachment even where the plank is distorted.

There is a need for a product that will remain attached to the upper surface of a deck and will accommodate change in expansion characteristics and warping of deck elements. It would be desirable to provide a product that satisfactorily covers a deck to refurbish the exposed surface while maintaining a reliable connection in an exterior environment at a reasonable cost. However, no suitable arrangement has been provided in the prior art for secure and accurate attachment of carpet covering material to deck planks in an efficient and low cost manner.

BRIEF SUMMARY OF THE INVENTION

An aspect of embodiments of the invention relates to a composite covering strip that is suitable for exterior use, especially on decks.

Another aspect of embodiments of the invention relates to a composite covering that forms both an initial adhesive bond and then forms a mechanical interlock with the surface that is covered.

A further aspect of embodiments of the invention relates to a composite covering that has a moldable layer that conforms and mates with the surface to which the covering is adhered.

The invention is directed to a method of applying a covering to a board. The steps comprise providing a flexible elongated strip of covering material including a fibrous layer with an integral moldable adhesive layer applied thereto and a release sheet secured over the moldable adhesive layer, wherein the release sheet has a separable positioning guide strip. The elongated strip of covering material is positioned on a board with the edges of the covering material aligned with the edges of the board. A length of the positioning guide strip is progressively removed to tack a portion of the elongated strip of covering material in place. A length of the remaining release sheet is removed to adhere the tacked portion of the elongated strip of covering material to the board. A second elongated strip of covering material is provided in a similar manner to another board. Preferably, the release sheet extends beyond the side edges of the composite strip so that a free edge of the release sheet can be grasped by an installer. An edge trim piece can be secured to exposed edges of the boards that form the decking surface.

Preferably, the moldable layer is formed of a hot melt adhesive. Preferably, the adhesive is applied in a volume between about 185–465 gsm, most preferably between about 355–465 gsm. Alternatively, the adhesive can be measured in terms of its thickness. The adhesive layer can be 5 mils or greater in thickness, preferably between about 5 mils and 17 mils thick, and more preferably at least about 7–15 mils thick. The release sheet can be formed of a silicon coated material. The moldable layer can be formed from any material that is malleable and either have a natural tackiness or have a layer of adhesive to provide a sticky outer surface.

The moldable material may be homogenous, such as a solid strip of pressure sensitive adhesive (PSA), or may be a composite. Preferably, the moldable layer is water impermeable, non-absorbent, substantially incompressible, and plastically deformable.

The composite strip can be packaged in a roll to facilitate shipping, storage, display and installation. The predetermined width of the composite strip and package is preferably less than twelve inches, most preferably between about eleven and twelve inches in width. The predetermined length can vary depending on application. An example of a suitable length is at least 10 feet, or up to about 350 feet, which would weigh less than about 32 pounds.

These and other aspects of the invention will become apparent when taken in conjunction with the detailed description and appended drawings.

BRIEF DESCRIPTION OF THE DRAWINGS

The invention will now be described in conjunction with the accompanying drawings in which.

In the drawings like reference numerals indicate corresponding parts in the different figures.

DETAILED DESCRIPTION OF PREFERRED EMBODIMENTS

This invention is directed to a surface covering in the form of a strip particularly suited for covering boards, also referred to as planks or decking, in an exterior environment or an environment subject to exposure to the elements. The invention is particularly suited for boards made of wood, i.e. lumber, which tend to have irregular surfaces and typically exhibit warping and irregularities along their length. However, the invention may also be used on plastic or plastic composite boards to provide a non-slip surface. Accordingly, this invention may be used on household decks, docks, wooden walkways, porches or other such structures. For purposes of simplicity, the term deck used herein is intended to refer to any structure formed of boards. Of course, the surface covering in accordance with this invention may also be used on any other type of surface desired to be covered with a fixed, durable covering.

The covering strip in accordance with this invention is specifically designed to facilitate refurbishing a horizontal deck surface. In a preferred form, as discussed in detail below, the covering strip is supplied in easily handled packages, such as rolls, for a homeowner or professional installer to use. However, it is also possible to supply precovered boards as building elements for such structures.

Figure 1:
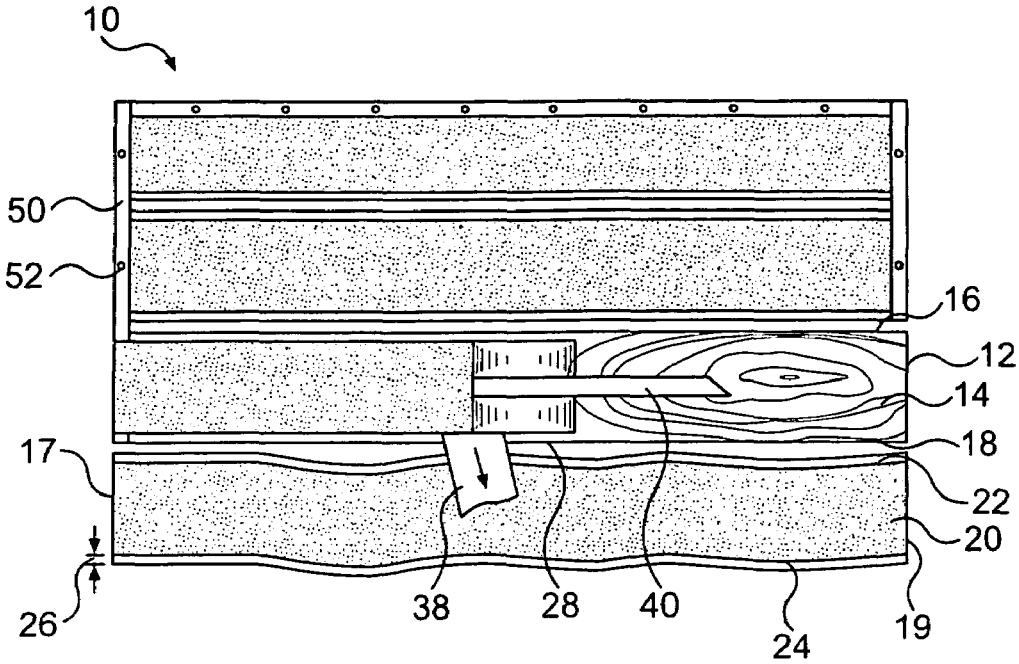
FIG. 1 is a top plan view of deck section with the covering strip applied and being applied thereto.

Referring to FIG. 1, a deck 10 suitable for use with this invention is illustrated. The deck 10 is formed of a series of slightly spaced elongated boards 12, as is known. As the deck 10 is outside, the spacing facilitates drainage and allows detritus to be easily removed. Each board 12 has an exposed surface 14, which in this case is an upper, horizontal surface, and an underneath or lower surface (seen in FIG. 4). The board 12 has opposed sides 16 and 18 that define a width of the exposed surface 14 and ends 17 and 19 that define a length. Obviously, the length of each particularly board 12 will vary according to the particular deck design. While the width can also vary, typically commercially available deck boards 12 are provided in 2×12 inch widths, which actually measure approximately between 1⅛ or 1½ by approximately 11½ inches, or ¾×6 inch widths (also called 2×6 inch widths), which actually measure about 1⅛ by 5¼ inches.

Each board 12 is nominally rectangular in cross-section and relatively straight in its elongate direction. However, as readily recognized by those of ordinary skill with lumber, many deck boards 12 are warped either prior to installation or become warped after installation due to the effects of weathering, as the lowermost board 12 illustrated in FIG. 1 shows.

A covering strip 20 is applied to the exposed surface 14 of the board 12. The covering strip 20 has opposed edges 22 and 24 along its length and has a predetermined width defined between the edges 22 and 24. The predetermined width can obviously vary, but is preferably established to be slightly less than the width of the exposed surface 14 of a typical board 12. As lumber typically has rounded edge, forming the width of the strip 20 slightly less than the board 12 allows the strip 20 to lay on the relatively flat exposed surface 14 and not overlap onto the rounded edges that lead to sides 16 and 18 of the board 12. For standard deck boards 12 that are ¾×6 inches, an appropriate width for the covering strip 20 is about 5½ inches or less, preferably less than 5¼ inches, and most preferably 5 inches. For other deck boards 12 that are 2×12 inches, an appropriate width for the covering strip 20 is about 11½ inches or less. By this configuration, when the strip 20 is applied to the exposed surface 14 of the board 12 a small gap 26 is formed on either side of the strip 20, which is described in detail below. Obviously, various widths can be used, including widths suitable for covering steps (2×10 boards) and 2×4 boards, for example.

Figure 2:
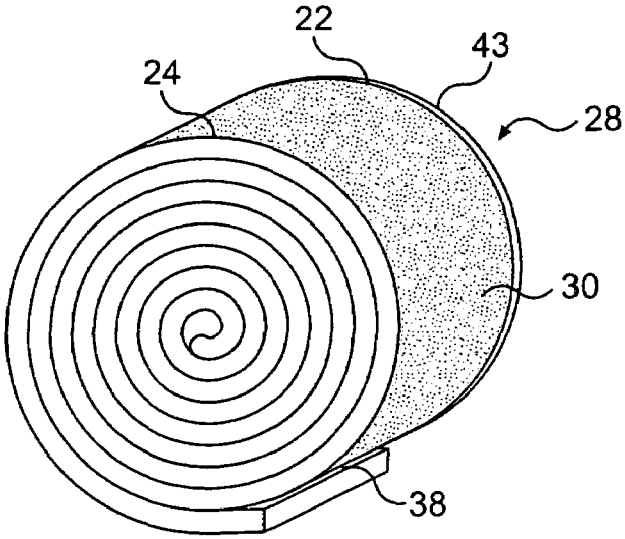
FIG. 2 is a side perspective view of the covering strip in a package roll.

The covering strip 20 is provided as an elongated strip, which can be any length, but is preferably a predetermined length that would be manageable when handled by an installer. An example of a suitable length would be 350 feet or less, which would weigh about 32 pounds or less. Of course, any length can be provided, for example 25 feet or less for smaller applications. For ease of handling and efficient shipping and storage, the covering strip 20 is preferably supplied in a roll 28, as seen in FIG. 2. The roll 28 is easily packaged, prevents wrinkling of the covering material, and facilitates installation.

Figure 3:
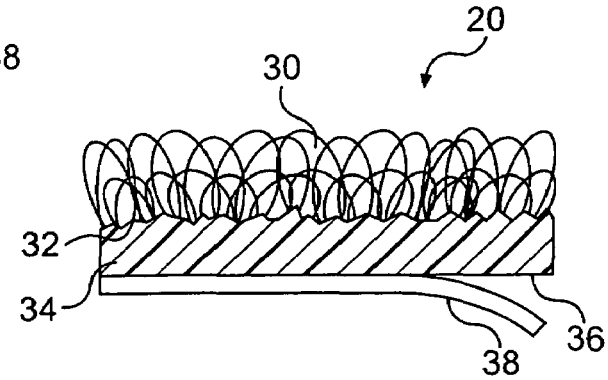
FIG. 3 is an enlarged side view in cross section of the covering strip.

Referring to FIG. 3, the covering strip 20 is formed as a composite including an outer fibrous layer 30, which may be a non-woven fibrous material commonly used in floor covering applications. The fibrous layer 30 is generally formed in a felting-type process which forms a layer of sufficient thickness to provide an attractive underfoot feel and anti-slip properties. The fibrous layer 30 may be stitch bonded, integrally maintained by a bonding agent, or a layer of fibers that are basically attached and supported to a support layer. The fibrous layer 30 could also be formed as a tufted product formed through a backing mesh.

In a preferred embodiment, for example, the fibrous layer 30 may be made or formed of extruded polypropylene fibers that are carded and then formed in a needle punching operation into a durable felt. Such a manufacture resists fraying and provides a flexible strip that that can flex laterally. The covering strip 20 should be flexible, especially in a side to side direction, and may have some elasticity. As is known, the fibrous layer 30 can be treated for fade resistance for exterior use, with for example UV (ultraviolet) protection.

The back surface 32 of the fibrous layer 30 provides integrity to the fibers and is preferably a treatment or coating. Ideally, the backing is thin or integral with the fibrous layer 30 so that the adhesive layer, discussed below, mechanically interlocks with the fibrous layer 30. The back surface 32 may be formed of a coating of SBR (styrene butadiene rubber), EVCL (ethyl vinyl chloride), vinyl, or acrylic, for example, with various additives if desired, such as clay. However, a coating layer may create undesirable bonding qualities between the adhesive and the back surface 32. If the fibrous layer 30 is formed on a mesh, generally a coating of latex is sprayed directly onto the mesh. In a preferred embodiment, the back surface 32 is merely the underside of the fibers. The underside may be singed. It is preferred that the back surface 32 not be formed of a foam backing layer or a porous material as is common in interior carpeting as this tends to become water logged and would disintegrate upon exposure to the elements.

Figure 4:
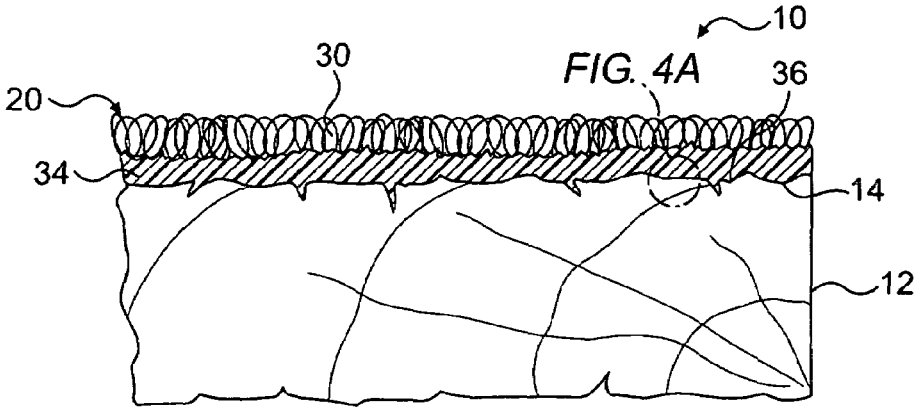
FIG. 4 is an enlarged side view in cross section of the covering strip applied to the deck as in FIG. 1.
Figure 4A:
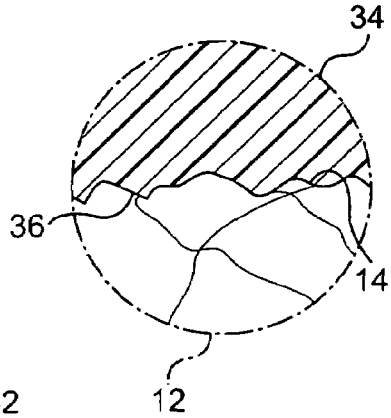
FIG. 4A is an enlarged portion of FIG. 4 showing a detail of the interface between the covering strip and a board.

As can be appreciated from FIGS. 3 and 4, the back surface 32 has an uneven, rough or irregular surface. Even with a coating or treatment, the back surface 32 may tend to remain uneven as the coating or treatment will follow the surface of the fibers.

The fibrous layer 30 is formed substantially in minimum thickness to achieve an acceptable underfoot layer. Such a weight can lie in the range of 10 oz/sqyd up to 30 oz/sqyd, for example. Of course, different thicknesses may be selected based on the actual material used for layer 30 and for the desired durability and intended geographic installation.

While the covering strip 20 preferably includes an upper surface of fibrous material, it can be formed of other materials which are of a character suitable for the upper surface of a floor covering material. Any material that renders the surface pleasant to touch and resistant to slip would be suitable. Other types of resilient material can therefore be used.

As seen in FIG. 3, a thick layer of moldable material 34 is formed onto the back surface 32 of the fibrous layer 30. As the back surface 32 of the fibrous layer 30 has no intervening layer, such as a foam layer, and is at most coated or treated, the moldable material 34 can preferably directly attach to the fibers of the fibrous layer 30. The moldable layer 34 is preferably made of a pressure sensitive adhesive (PSA) that is a hot melt, meaning it is applied to the fibrous layer 30 at 100% solids. Suitable adhesive compositions are available from many different manufacturers and can be used as a hot melt adhesive applied onto the back surface 32. The application techniques can vary depending on the particular adhesive composition, but one effective method is for the adhesive to be sprayed on and, if desired, treated with pressure and/or vacuum to enhance physical penetration of the fibrous layer 30. It is also possible to apply the adhesive by laying a strip of adhesive material on the back surface 32. It is preferred that hydrophilic adhesives not be used, as such adhesives would inhibit drying of the strip 20 during exterior use.

Any type of moldable or malleable material application is suitable as layer 34 as long as it forms a strong, yet flexible integral structure providing a fibrous layer 30 with a moldable layer 34 directly bonded thereto and an outer surface having an adhesive quality. As noted above, the moldable layer 34 may be a single material, such as a PSA. The layer 34 may also be a composite layer formed of a malleable material, such as silicon caulking, green rubber or other flowable material, with an inherent adhesive quality or an adhesive layer applied to the outer surface. If the moldable material is not inherently adhesive, it may be desirable to apply the moldable layer 34 to the back surface 32 of the fibrous layer 30 by an adhesive or other secure attachment technique. The viscosity of the moldable material may also be varied to affect penetration. The moldable material may also function as a waterproof layer based on its composition and/or thickness. It is preferred that the material be free of foamed voids, either open cell or closed cell.

As best seen in FIGS. 2 and 4, the moldable layer 34 has a bottom surface 36, which can be smoothed by the application technique, if needed. This results in a variable thickness of moldable layer 34 that ranges from the peaks and valleys of the uneven back surface 32 of the fibrous layer 30 to the smooth bottom surface 36 of the moldable layer 34. As the moldable layer 34 will become integrally attached to the surface that it covers, it is important to obtain 100% coverage of the bottom surface 36.

As noted above, in this invention, the moldable layer 34 is applied as a thick layer. The minimum thickness measured between the peaks of the uneven back surface 32 and the bottom surface 36 is preferably at least 5 mils so as to provide sufficient thickness of adhesive material to obtain complete coverage even at the minimum thicknesses at the peaks to allow molding of the strip 20 to the exposed surface 14 of the board 12, as described in more detail hereinafter. The range of preferred thickness of the moldable layer 34 is between about 5 mils and 17 mils, preferably at least 7 mils and on average about 15 mils. A better method of measuring the moldable layer is the applied volume or amount, as the thickness can vary depending upon application techniques and the density of the moldable material. The preferred volume or amount of moldable material is at least about 185 gsm, preferably in a range of approximately 185–465 gsm, and most preferably about 355–465 gsm, applied to the fibrous layer 30. These values are based on use of a PSA. It is contemplated that with different molding materials, application techniques, and environments that different volumes or amounts could be successfully used as long as the material has the ability to mold to the irregular surface of the boards to form a permanent bond. For example, it is contemplated that a volume of about 100 gsm given the appropriate material could be used, especially in climates that do not experience freeze/thaw cycles. It is also contemplated that in certain applications, strips of moldable material may be used rather than a solid layer.

FIG. 3 also shows a release sheet 38 applied over the bottom surface 36 of the moldable layer 34. Preferably, the bottom surface 36 has been smoothed, as discussed above, or, if not, will be smoothed by the addition of the release sheet 38. The release sheet 38, which is also called a liner, can be formed of any releasable sheet material that is easily pulled from the bottom surface 36 of the moldable layer 34. A suitable material is silicon coated paper. However, other materials may be used, including films such as high density films, polyethylene, polyesters, UV curable silicon coated elastomeric polyurethane. A preferred material is a polyester sheet about 1–2 mils thick. The important features of the sheet 38 are that it releases reliably from the adhesive surface of the moldable layer 34 and avoids tearing so that it is easy for an installer to use. Obviously, the type of adhesive surface used may affect the decision regarding the choice of release sheet 38.

The release sheet 38 can also carry a release additive applied to one side that contacts the adhesive and prevents the adhesive surface material from penetrating the sheet 38 and thus contacting the top surface of the fibrous layer 30 when rolled. In the alternative, the fibrous layer 30 itself may be treated with the same release additive, thus avoiding the necessity for treating the release sheet 38.

it is also possible to form the release sheet 38 of a fabric material that has a degree of stretch so that when rolled into the roll 28, as shown in FIG. 2, the release sheet 38 will stretch longitudinally to accommodate the increase in diameter caused by rolling the thickness of the strip 20.

Figure 5:
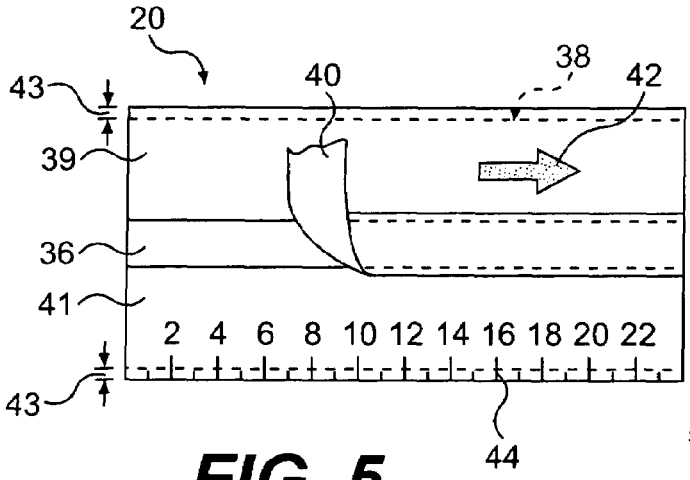
FIG. 5 is bottom view of the covering of FIG. 3 showing a release sheet configuration for the covering strip in accordance with an embodiment of the invention.

The release sheet 38 may be provided as a single sheet that spans the width of the strip 20. It may also be provided as a series of sheets the width of the strip 20 arranged along the length of the strip 20 so that as the strip 20 is applied to a board 12 progressive lengths of the moldable layer 34 may be exposed. As seen in FIG. 5, the outer edges of the release sheet 38 preferably extend beyond the edges of the strip 20 with a free edge 43. This creates a grasping surface to effect removal of release sheet 38 as discussed below.

In a preferred embodiment illustrated in FIG. 5, the release sheet 38 is formed in separate longitudinal strips 39, 40, 41, with a relatively central strip 40 extending the length of the strip 20. The longitudinal strips 39, 40, 41 are arranged side by side across the width of the bottom surface 36 of the moldable layer 34. The central strip 40 can be relatively narrow, such as an inch or less. Preferably, the strips 39, 40, 41 are arranged in an overlapping relationship, as shown in FIG. 5, with the central strip 40 overlapping the underlying side strips 39 and 41. However, while the overlap assists in removing the strip 40 and prevents the exposure of the moldable layer 34 from between adjacent strips, it is not necessary. The strips of release sheet 38 may be applied to the moldable layer 34 as pre-cut strips or can be applied as a single sheet and then separated, by laser for example. Of course, any number of longitudinal strips could be used, including two or four or more. The significance of at least one generally centrally located strip 40 is discussed below.

The central release strip 40 is designed to be used as an initial tack area during installation. The release strip 40 can be removed wholly or partially from the length of the covering strip 20 to be applied onto the deck board 12 providing an initial tack area to center and accurately position the covering strip 20 on the exposed surface 14 of the board 12 while the remaining part of the covering strip 20 remains unconnected due to the presence of the release strips 39 and 41. After the covering strip 20 is properly applied onto the board 12 at the required position with the edges 22 and 24 directly aligned with the sides 16 and 18 of the exposed surface 14 of the board 12, as seen in FIG. 1, the release strips 39 and 41 can be removed by grasping the free edges 43 of the particular release strip and peeling the release sheet 39 or 41 away to allow the adhesive surface of the moldable layer 34 to contact the exposed surface 14 of the board 12. Thus, complete adhesion of the strip 20 across the full width of the board 12 is only effected after the strip 20 is securely positioned and tacked in place with the central portion of the adhesive surface of the moldable layer 34 exposed by release strip 40. The same approach can be used with a narrow strip along one side which is applied first, leaving the remainder of the release strip to be removed later.

This method of installation is especially useful in a situation where the deck boards 12 are warped. Since only the central area of the adhesive surface of the moldable layer 34 is exposed and the strip 20 has been manufactured with flexibility in its lateral direction, it is possible to steer or bend the covering strip 20 to follow the warped curvature of the board 12 to precisely lay the strip 20 in close conformance with the edges 16 and 18. Following the initial tacking by removing the release strip 40, complete bonding of the slightly bowed covering strip 20 can be effected by full release of the sheet 38. This method also avoids the common occurrence of wrinkling during application of adhesive coated material. As the adhesive can be quite aggressive, once the strip 20 is laid down, it is difficult to pull it up to straighten wrinkles that may occur during application. Additionally, pulling up the entire adhered strip 20 will pull up particles of the board 12 and thus contaminates the adhesive layer 34 with particles of board and dirt and compromises the adhesive qualities. By adhering the strip 20 in place with a small strip of adhesive under release strip 40, the strip 20 can be repositioned and wrinkles can be worked out by either manipulating the remainder of the non-adhered strip 20 or by merely pulling up the small centrally adhered portion.

Also shown in FIG. 5, the release sheet 38 may carry certain indicia and information. Carpeting has pile that extends in a particular direction. It is important for aesthetic purposes to orient strips or pieces of carpeting so that the pile extends in the same direction. Otherwise, if the pile extends in opposite directions, the various pieces will appear to be a different color due to the reflection of the light, which can result in an unwanted striping effect. The release sheet 38, therefore, can carry indicia 42, in this case an arrow, indicating the direction of the pile. By this, an installer can ensure that the pile of each strip 20 extends in the same direction.

The release sheet 38 can also be pre-printed with measurements 44 to assist in cutting lengths from the strip 20 during installation. For example, when resurfacing a deck 10 that is 15 feet wide, it may be useful to pre-cut about 15 foot lengths from the roll 28 to ease installation. The pre-printed measurements 44 make it very easy for the installer to make accurate cuts and avoid mistakes in measuring. Of course, any type of information may be provided on the release sheet 38, including installation instructions and logos. The release sheet 38 may be printed with the indicia or the indicia may be formed during manufacture of the sheet 38, such as by UV curing.

To assemble the covering strip 20 onto a deck 10, a length of the carpeting strip 20 is cut from the roll 28 or the entire roll 28 is placed on one end of the board 12 on top of the exposed surface 14. For ease and efficiency of installation, it is preferred that the roll 28 be provided with the release sheet 38 facing outwardly. If a length is cut from the roll 28, the length can be rolled into a smaller roll to assist in handling the strip 20. Starting at one end of the board 12, the strip 20 is positioned between the sides 16 and 18 of the exposed surface 14 of the board 12, preferably with a small gap 26 on each side. The end of the strip 20 may be located at the edge 17 of the board or slightly overlapping the edge 17 if desired. The release sheet 38 is then removed to expose the bottom surface 36 of the adhesive surface of the molding layer 34. In the case of a central release strip 40, only the central release strip 40 is removed to enable the installer to tack a portion of the strip 20 in place. Additional length of the strip 20 is rolled out or otherwise positioned on the board 12 while tacking the central area in place. By this, the covering strip 20 may be steered along the board 12 laterally shifting and conforming to the variations in the board 12. When the entire strip 20 is tacked in place and the installer is satisfied with the position and the appearance, the free edges 43 of the remaining release sheets 39 and 41 are grasped and peeled away on either side to secure the entire width of the covering strip 20 to the exposed surface 14. This procedure is followed for each board 12. If desired, the strip 20 could be applied progressively along the length of the board 12.

FIG. 1 illustrates this process showing a board 12 with the covering strip 20 secured to the first half of the length of the board 12 while the central release strip 40 is torn away for tacking the leading edge down. One of the side release strips 38 is shown peeled back to secure the side edges of the covering strip 20. Preferably, the side release strips are peeled back after the entire length of the strip 20 is applied to the board 12.

The moldable layer 34 is sufficiently thick to provide a secure attachment to the exposed surface 14 of the board 12. This exposed surface has inherent recesses, cracks and other discontinuities or distortions as is common with lumber. It should be well appreciated that wood is not a homogenous material so that many such cracks and imperfections are present. Even the absence of cracks, there are other discontinuities formed by the grain of the wood and by cut marks formed in the wood. Weathering also creates additional texture, cracking and discontinuities on the surface. Thus the exposed surface 14 of boards 12 is highly variable both in height and line due to twisting or warping and on a small scale by the cracks and other discontinuities described above.

The moldable layer 34, particularly the hot melt pressure-sensitive adhesive of the preferred embodiment, is selected to provide an initial high level of tack or aggression of adhesion so that the covering strip 20 initially securely bonds to the exposed surfaces 14 of the deck 10. The aggression of the adhesive is sufficient that it applies adhesive contact across substantially the full width of the exposed surface 14 of each board 12, but does not necessarily engage into individual cracks in the wood immediately upon contact. The initial attachment is therefore provided by the aggressive action of the adhesive surface of the moldable layer 34. The layer 34 creates a bond between the fibers of layer 30 and the exposed surface 14 of the deck 10. The strip 20 is sealed to the board 12 to prevent moisture from penetrating between the fibrous layer 30 and the board 12.

In fact, over time, due to various factors, including freeze-thaw cycles, the entry of moisture and other contaminants in the strip 20, and general wear and tear, the adhesive effect of the adhesive surface of the moldable layer 34 can reduce. The thickness of the moldable layer 34 is therefore designed so that over time the material is molded by pressure of normal exterior use into the exposed surface 14 of the wood so that it engages into cracks and other distortions in the board 12 to provide a secondary adhesive effect caused by the molding action. Thus, even when the initial adhesive effect of the layer 34 has deteriorated or even disappeared, a mechanical interlock or adhesion remains due to the molding or flow of the moldable layer 34 into the discontinuities in the exposed surface 14. The moldable layer 34 thus mates with the surface 14 and provides a secure attachment in the long term between the fibers of layer 30 and the board 12.

As discussed above, the preferred minimum volume or amount of adhesive is about 185 grams/square meter. Expressed in another way, the preferred minimum thickness of the moldable layer 34 is about 5 mils and an average thickness between the smooth bottom surface 36 of the adhesive surface of the moldable layer 34 to the back surface 32 of the fibrous material 30 is about 15 mils. This amount of material provides sufficient material to cause the above molding effect. This amount also ensures that there is bonding upon the initial application of the covering strip 20 onto the board 12 across its full width taking into account possible distortion of the board 12 caused by warping and other larger scale discontinuities or variations. In addition, use of a hot melt adhesive material provides a resultant plastic material that is relatively plastic allowing the adhesive to deform and engage the cracks and other discontinuities in the board 12. Thus, it is important that no voids of any substantial size, other than those that appear within cracks in the board 12, are formed during the initial application. Such voids between the covering strip 20 and the exposed surface 14 can trap moisture or contaminants, which will expand in a freeze/thaw cycle. Expansion rapidly increases the separation between the components that can cause a typical breakdown of adhesion over the covered area. The complete coverage of the moldable layer 34 in accordance with this invention can ensure that voids are not created during application.

Figure 6:
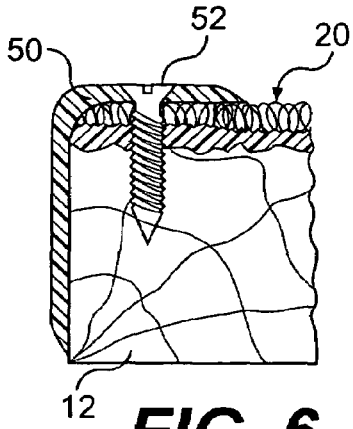
FIG. 6 is an enlarged side view in cross section of edging applied to an end of a covered board in accordance with an embodiment of the invention.

An optional final step in assembly is to add an edge trim piece 50, seen in FIGS. 1 and 6. Exposed edges of the deck 10 either at the sides or ends or on a step are typically easily scuffed or torn in use. While the moldable layer 34 set forth above provides sufficient short term adhesive and long term adhesion to effectively maintain the main body of the covering strips 20 in engagement with the exposed surfaces 14 of the deck 10, it is in some cases insufficient to tolerate scuffing, tearing, or lifting caused by the engagement of feet or other parts of persons or objects pulled across the surface. Thus, an exposed edge of the covering strip 20 can be lifted, acting to slightly break away the connection to the board 12 at the edge. Once this has occurred, further lifting can continue until the remainder of the connection under the main body of the strip 20 breaks down.

To prevent this initial action or to provide a pleasing finished appearance, an edge trim piece 50 can be applied at the edges 16, 17, 18, or 19, as seen in FIG. 1. The trim piece 50 can be formed as any shape, but is preferably an angle piece that folds over both exposed surfaces at the corners of the board 12. The piece 50 can be secured to the board with a fastener 52, such as a screw, in a countersunk aperture, for example. If desired, the piece 50 can be coordinated in appearance with the fibrous layer 30 to present a pleasant uniform appearance. The piece 50 may be formed of plastic, metal, wood or any material suitable for high traffic, exterior use. By this, the whole area of the covering strip 20 at the exposed edge of the deck 10 is protected by the trim piece 50 to prevent the edge of the strip 20 from being lifted. It is noted that the trim piece 50 is entirely optional and the adhesive layer 34 retains the remainder of the strip 20 in place over the main area of the covering strip 20 on the exposed surface 14 of the board 12.

Various modifications can be made in my invention as described herein, and many different embodiments of the device and method can be made while remaining within the spirit and scope of the invention as defined in the claims without departing from such a spirit and scope. It is intended that all matter contained in the accompanying specification shall be interpreted as illustrative only and not in a limiting sense.

What is claimed is:

1. A method of applying a covering for exterior use, comprising:

providing a flexible elongated strip of covering material having side edges and including a fibrous layer with an integral moldable adhesive layer applied thereto and a release sheet secured over the moldable adhesive layer, wherein the release sheet has a separable positioning guide strip located in a central region between the side edges and extending the length of the strip of covering material;

positioning the elongated strip of covering material on a board with the edges of the covering material aligned with the edges of the board;

progressively removing a length of the positioning guide strip to tack a longitudinal central portion of the elongated strip of covering material in place by adhering the central region and leaving the side edges covered with the release sheet to allow the side edges of the elongated striped to move relative to the board;

removing a length of the remaining release sheet to finally position the material and adhere the entire width of the elongated strip of covering material to the board;

providing a second elongated strip of the covering material;

positioning the second elongated strip of covering material on another board;

progressively removing a length of the positioning guide strip to tack a longitudinal central portion of the elongated strip of covering material in place; and removing a length of the remaining release sheet to finally position the material and adhere the entire width of the elongated strip of covering material to the other board.

2. The method of claim 1, wherein progressive removal of the guide strip occurs prior to the removal of the length of the remaining release sheet.

3. The method of claim 1, wherein progressive removal of the guide strip occurs intermittently with the removal of a length of the remaining release sheet.

4. The method of claim 1, further comprising securing a trim piece to an end of the board with the strip of covering material adhered thereto.

5. The method of claim 1, wherein providing the elongated strip of covering material includes applying the layer of hot melt adhesive to a back surface of the fibrous layer as the moldable adhesive layer.

6. The method of claim 1, wherein applying the moldable adhesive layer includes applying the layer in a thickness of about 5 mils to 17 mils.

7. The method of claim 1, wherein applying the moldable adhesive layer includes applying the layer in a volume of at least about 185 grams per square meter.

8. The method of claim 1, wherein applying the moldable adhesive layer includes applying the layer in a volume of about 355–465 grams per square meter.

9. The method of claim 1, wherein after the portion of the elongated strip of covering material is tacked in place and prior to removing a length of the remaining release sheet to adhere the entire width of the elongated strip of covering material to the board, further including finally positioning the elongated strip of covering material on the board by flexing the material and steering the elongated strip of covering material by laterally shifting the material to conform to the shape of the board in the longitudinal direction.

10. The method of claim 1, further providing indicia on the release sheet.

11. The method of claim 10, wherein providing indicia includes providing an indication of a direction of pile of the fibrous layer.

12. The method of claim 10, wherein providing indicia includes providing measuring marks.

13. The method of claim 1, wherein providing the strip of covering material includes providing the release sheet with free edges that extend beyond sides of the fibrous layer, and removing the length of the remaining release sheet includes grasping the free edges.

14. The method of claim 1, wherein providing an elongate strip of covering material includes providing the strip in a roll having a width of about twelve inches or less.

15. The method of claim 1, wherein providing an elongated strip of covering material includes providing the release sheet in three pieces across the width of the strip, including two side pieces and a middle piece that forms the positioning guide strip.

* * * * *